US010688401B1

(12) United States Patent
Brister et al.

(10) Patent No.: US 10,688,401 B1
(45) Date of Patent: Jun. 23, 2020

(54) SYSTEM AND METHOD TO CONTROL ENTERTAINMENT FIGURES

(71) Applicant: Universal City Studios LLC, Universal City, CA (US)

(72) Inventors: Michael Keith Brister, Winter Garden, FL (US); Dwain South, Orlando, FL (US); Robert Charles Aradio, Orlando, FL (US); Gerard Howland, Orlando, FL (US); Darrin Hughes, Orlando, FL (US)

(73) Assignee: Universal City Studios LLC, Universal City, CA (US)

( * ) Notice: Subject to any disclaimer, the term of this patent is extended or adjusted under 35 U.S.C. 154(b) by 0 days.

(21) Appl. No.: 16/257,184

(22) Filed: Jan. 25, 2019

Related U.S. Application Data

(60) Provisional application No. 62/789,624, filed on Jan. 8, 2019.

(51) Int. Cl.
*A63G 31/02* (2006.01)
*A63J 5/02* (2006.01)
*B61F 5/52* (2006.01)

(52) U.S. Cl.
CPC ..... *A63G 31/02* (2013.01); *A63J 5/02* (2013.01); *B61F 5/52* (2013.01)

(58) Field of Classification Search
CPC ..... A63G 19/20; A63G 31/00; A63G 31/02; A63G 31/16; A63F 13/00; A63F 13/12; A63F 22/00; A63F 22/16
USPC ..... 472/50, 59, 75–78, 80, 81, 83–84, 130; 434/29, 55; 104/112–113, 117, 117.1; 105/30, 148, 150–151
See application file for complete search history.

(56) References Cited

U.S. PATENT DOCUMENTS

| | | | |
|---|---|---|---|
| 328,899 | A | 10/1885 | Morrison |
| 3,333,713 | A | 8/1967 | Frido |
| 3,353,503 | A | 11/1967 | Pettit |
| 3,457,876 | A | 7/1969 | Holden |
| 3,847,085 | A | 11/1974 | Rypinski |
| 4,641,587 | A | 2/1987 | Dalliard |
| 4,666,362 | A | 5/1987 | Landsberger et al. |
| 4,883,184 | A | 11/1989 | Albus |

(Continued)

FOREIGN PATENT DOCUMENTS

| | | |
|---|---|---|
| CN | 102309853 B | 5/2013 |
| CN | 206642355 | 11/2017 |

(Continued)

OTHER PUBLICATIONS

Todd D. Murphey et al.; "Control Aesthetics in Software Architecture for Robotic Marionettes," American Control Conference, 2011, pp. 1-6.

(Continued)

*Primary Examiner* — Kien T Nguyen
(74) *Attorney, Agent, or Firm* — Fletcher Yoder, P.C.

(57) ABSTRACT

An entertainment figure system includes an entertainment figure having an attachment point, a bogie coupled to a track and to the attachment point of the entertainment figure via a cable and a winch coupled to the cable. The bogie is configured to translate along the track and the winch is configured to adjust a length of the cable extending from the winch and thereby modify a distance between the attachment point and the bogie.

20 Claims, 5 Drawing Sheets

(56) References Cited

U.S. PATENT DOCUMENTS

| | | | | |
|---|---|---|---|---|
| 5,431,246 | A | 7/1995 | Matherly | |
| 6,189,455 | B1 | 2/2001 | Thompson | |
| 6,406,299 | B1 | 6/2002 | Murao et al. | |
| 6,511,381 | B1 | 1/2003 | Cochron | |
| 6,566,834 | B1 | 5/2003 | Albus et al. | |
| 6,648,102 | B2 | 11/2003 | Bostelman et al. | |
| 6,808,459 | B2 | 10/2004 | Checketts | |
| 7,624,684 | B2 | 12/2009 | Morris | |
| 8,147,344 | B2 * | 4/2012 | Crawford | A63G 31/16 104/112 |
| 8,761,927 | B2 | 6/2014 | Johnson et al. | |
| 8,920,251 | B2 * | 12/2014 | Dietz | A63G 21/20 434/55 |
| 8,961,326 | B2 * | 2/2015 | Fisher | F16M 11/043 104/112 |
| 9,303,421 | B1 * | 4/2016 | Jennings | F16M 13/022 |
| 9,393,497 | B2 * | 7/2016 | Valtiner-Zuegg | A63J 25/00 |
| 10,258,893 | B2 | 4/2019 | Freedman et al. | |
| 10,500,507 | B2 | 12/2019 | White | |
| 2009/0038499 | A1 | 2/2009 | Morris | |
| 2010/0227527 | A1 | 9/2010 | Smoot et al. | |
| 2014/0231590 | A1 | 8/2014 | Trowbridge et al. | |
| 2016/0023121 | A1 | 1/2016 | McVeen | |

FOREIGN PATENT DOCUMENTS

| | | | |
|---|---|---|---|
| EP | 1063064 | A2 | 12/2000 |
| GB | 2305645 | A | 4/1997 |
| TW | 201323043 | | 6/2013 |
| WO | 8301428 | A1 | 4/1983 |

OTHER PUBLICATIONS

Creating a Stewart Platform Model Using SimMechanics, Mathworks, Oct. 16, 2013, 8 Pages.

PCT/US2020/012086 Invitation to Pay Additional Fees Mar. 24, 2020.

* cited by examiner

SYSTEM AND METHOD TO CONTROL ENTERTAINMENT FIGURES

CROSS REFERENCE TO RELATED APPLICATIONS

This application claims priority from and the benefit of U.S. Provisional Application Ser. No. 62/789,624, entitled "SYSTEM AND METHOD TO CONTROL ENTERTAINMENT FIGURES", filed Jan. 8, 2019, which is hereby incorporated by reference.

BACKGROUND

The present disclosure relates generally to the field of amusement park entertainment. More specifically, embodiments of the present disclosure relate to a system to control entertainment figures via cables.

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Amusement parks include a variety of features providing unique experiences to park guests. For example, the amusement park may include entertainment figures (e.g., animated figures) that provide entertainment for park guests, such as on a ride or at a show of the amusement park. The entertainment figures may differ in size and/or movement to provide a variety of entertainment. However, flexible control of certain entertainment figures may be difficult. For example, it is now recognized that large entertainment figures may be difficult to control in an accurate and/or precise manner while still allowing for movements that appear natural.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, an entertainment figure system includes an entertainment figure having an attachment point, a bogie coupled to a track and to the attachment point of the entertainment figure via a cable and a winch coupled to the cable. The bogie is configured to translate along the track and the winch is configured to adjust a length of the cable extending from the winch and thereby modify a distance between the attachment point and the bogie.

In an embodiment, an entertainment figure system includes an entertainment figure comprising an attachment point, a bogie coupled to a track and to the attachment point of the entertainment figure via a cable, and a winch coupled to the cable and configured to adjust a length of the cable extending from the winch and thereby modify a distance between the attachment point and the bogie. The amusement park attraction system further includes a controller communicatively coupled to the bogie and to the winch, in which the controller is configured to adjust a location of the bogie along the track, and the controller is configured to operate the winch to adjust the length of the cable extending from the winch.

In an embodiment, an entertainment figure system includes an entertainment figure having a first attachment point and a second attachment point, a first bogie coupled to a first track and to the first attachment point via a first cable, a second bogie coupled to a second track and to the second attachment point via a second cable, a first winch coupled to the first cable and configured to adjust a first length of the first cable extending from the first winch and thereby modify a first distance between the first attachment point and the first bogie, and a second winch coupled to the second cable and configured to adjust a second length of the second cable extending from the second winch and thereby modify a second distance between the second attachment point and the second bogie. Furthermore, the first track is positioned between the entertainment figure and a ceiling, in which the first bogie is configured to translate along the first track, and the second track is positioned between the entertainment figure and a floor, in which the second bogie is configured to translate along the second track.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

DETAILED DESCRIPTION

Figure 1:
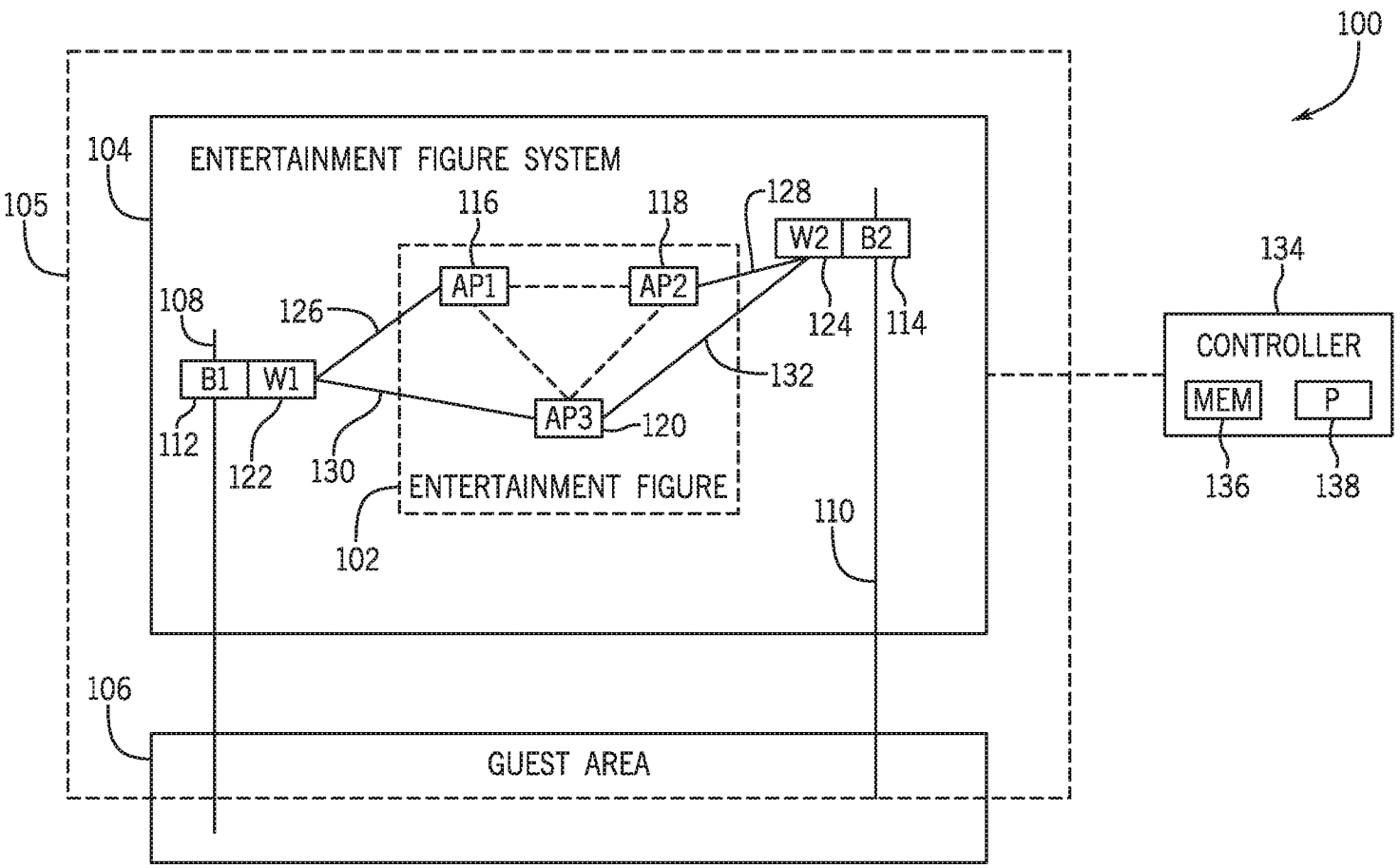
FIG. 1 is a plan view of an embodiment of an amusement park attraction that includes an entertainment figure system that adjusts a position of an entertainment figure, in accordance with aspects of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Embodiments of the present disclosure include a system that controls an entertainment figure. Entertainment figures may be implemented at amusement parks to enhance a guest's experience. In general, an entertainment figure may contribute to a sentiment of the guest, such as thrill, fright, humor, and so forth. For example, in a ride of the amusement park, in which a guest may be positioned on a ride vehicle of the ride, an entertainment figure may appear (e.g., be transported) near the ride vehicle at a certain point during the ride, such as at a certain area of a track of the ride or and/or at a certain time of the ride. Additionally or alternatively, at a show of the amusement park, the entertainment figure may appear near where guests are seated at a certain time of the show. In addition to being transported to and from different locations, certain parts (e.g., an appendage) of entertainment figures may also move relative to other parts of the entertainment figure. As can be appreciated, movement of the entertainment figure may add to the experience provided by the entertainment figure. In other words, the combination of the appearance and the movement of the entertainment figure may further enhance a guest's experience.

Actuators may provide both transportation and movement of the entertainment figure. As used herein, transportation refers to conveying (e.g., translating) the entire entertainment figure to a different location and movement refers to arranging a certain part of the entertainment figure to a different position relative to a remainder of the entertainment figure. In certain systems, actuators may be limited in providing a degree of movement to entertainment figures. In other words, certain parts of entertainment figures may possess a limited range of motion. In other systems, entertainment figures may be limited to a specific configuration (e.g., size, weight, shape) suitable to the specific system (e.g., actuator specification) provided. Thus, implementing certain entertainment figures may increase costs of operation and/or result in limited motion.

Therefore, it is presently recognized that a system capable of providing a flexible degree of movement for entertainment figures of different configurations is beneficial in enhancing a guest's experience. Specifically, the system may use a cable coupling a part of an entertainment figure to a bogie. The cable may extend and/or retract via the bogie to move the part of the entertainment figure. Additionally, the bogie may be implemented on a track and may translate on the track to move the part and/or to transport the entire entertainment figure. Each entertainment figure may be coupled to multiple cables, in which each cable may couple a different part of the entertainment figure to a respective bogie. Positioning of the bogies and of the cables in a particular manner may enhance transportation and/or movement of the entertainment figure to entertain guests accordingly. It should be understood that, as used herein, an entertainment figure includes any type of figure that may be positioned to entertain guests at an amusement park or other venue, including an animated figure (e.g., a figure or puppet animated by an electromechanical device), a person, a robot, a ride vehicle, and so forth, and the embodiments of the systems described herein may be implemented to different types of entertainment figures.

Turning now to the drawings, FIG. 1 is a schematic view of an embodiment of a show system 100 that may be used to adjust (e.g., move, animate) an entertainment FIG. 102 at an amusement park. For example, the show system 100 may be used at an attraction of the amusement park, in which guests may experience the show system 100. An entertainment figure system 104 may be considered to be positioned in a show area 105 of the show system 100. Generally, the show area 105 may include elements of the show system 100, such as animated figures, performers, show effects, and the like. In a non-limiting embodiment, the show area 105 may be adjacent to and/or overlap with a guest area 106, where guests may be positioned, such as to be seated at and view the entertainment FIG. 102. As such, the entertainment figure system 104 may be configured to be transported from the show area 105 into the guest area 106, and/or the entertainment figure may be concurrently positioned in both the show area 105 and the guest area 106.

Certain features of the entertainment figure system 104 may adjust a position of the entertainment FIG. 102. For example, the entertainment figure system 104 may include a first track 108 and a second track 110. A first bogie 112 may be disposed on the first track 108 and a second bogie 114 may be disposed on the second track 110. In the illustrated embodiment, the first and second bogies 112, 114 are each configured to translate along the respective first and second tracks 108, 110. In one embodiment, the entertainment FIG. 102 may include a first attachment point 116, a second attachment point 118, and a third attachment point 120. Each attachment point 116, 118, 120 of the entertainment FIG. 102 may be coupled to at least one of the bogies 112, 114. Specifically, each attachment point 116, 118, 120 of the entertainment FIG. 102 may be coupled to a first winch 122 of the first bogie 112 and/or a second winch 124 of the second bogie 114 via cables. As an example, a first cable 126 may couple the first attachment point 116 to the first winch 122, a second cable 128 may couple the second attachment point 118 to the second winch 124, a third cable 130 may couple the third attachment point 120 to the first winch 122, and a fourth cable 132 may couple the third attachment point 120 to the second winch 124. In this manner, as the first bogie 112 and/or the second bogie 114 translate along the respective first track 108 and second track 110, the respective positions of the attachment points 116, 118, 120 may be adjusted. In one embodiment, the first track 108 and/or the second track 110 may extend near or within the guest area 106. In this manner, at least a portion of the entertainment FIG. 102 may extend into the guest area 106, such as when the first bogie 112 and/or the second bogie 114 translates along the respective first track 108 and second track 110 near or within the guest area 106.

Furthermore, the respective positions of the attachment points 116, 118, 120 may be adjusted via the first and second winches 122, 124. Particularly, the winches 122, 124 may extend and/or retract the respective cables 126, 128, 130, 132 to adjust the respective extended lengths of the cables 126, 128, 130, 132 (i.e., the length of the cable extending from the respective winches). As should be understood, as each winch 122, 124 retracts the respective cables 126, 128, 130, 132, the cable 126, 128, 130, 132 may wind and be spooled within the respective winch 122, 124. As each winch 122, 124 extends the respective cables 126, 128, 130, 132, the cable 126, 128, 130, 132 may unwind from within the respective winch 122, 124. Adjusting the respective extended lengths of the cables 126, 128, 130, 132 may adjust the position of the respective attachment points 116, 118, 120 relative to one another. For example, adjusting an extended length of the first cable 126 may adjust the position of the first attachment point 116 relative to the second attachment point 118 and the third attachment point 120. In certain embodiments, the attachment points 116, 118, 120 may also be coupled to one another. In this manner, movement of one of the attachment points 116, 118, 120 may move another attachment point 116, 118, 120. As should be understood, movement of the attachment points 116, 118, 120 may additionally or alternatively adjust a position of the entertainment FIG. 102. In other words, movement of one of the attachment points 116, 118, 120 may adjust an orientation of the entertainment FIG. 102, a location of the entertainment FIG. 102 relative to the tracks 108, 110, or both.

Adjustment of the entertainment FIG. 102 may generally enhance the experience of a guest in the show system 100. In one example, the adjustment of the attachment points 116, 118, 120 may enhance control of the entertainment FIG. 102 to move into multiple possible orientations, alignments, and/or arrangements. Specifically, the extended length of each cable 126, 128, 130, 132 and/or the location of each bogie 112, 114 along the track may be controlled to enable positioning each of the attachment points 116, 118, 120 to a target position. Thus, a substantially exact positioning of the entertainment FIG. 102 may be achieved. Additionally, adjustment of the attachment points 116, 118, 120 may move the entertainment FIG. 102 in a realistic manner as viewed by the guests. That is, extension and/or retraction of the respective cables 126, 128, 130, 132 may move the attachment points 116, 118, 120 in a smooth and natural manner as seen by the guests. In another example, translating the first and/or second bogies 112, 114 along the first and/or second tracks 108, 110 may transport the entertainment FIG. 102 into or near the guest area 106 to enhance the guests' experience. In one embodiment, the entertainment FIG. 102 may interact with the guest area 106. That is, the entertainment FIG. 102 may move and/or be transported to engage with the guest area 106, including contacting or nearly contacting a portion of the guest area 106, for example.

In one embodiment, the show system 100 may include a controller 134 communicatively coupled with the entertainment figure system 104 and the controller 134 may be implemented to control movement of and/or adjustment of the entertainment FIG. 102. By way of example, the controller 134 may be communicatively coupled with and implemented to control movement of the first and/or second bogies 112, 114 along the first and/or second tracks 108, 110. The controller 134 may additionally or alternatively be communicatively coupled with and implemented to control the first and/or second winches 122, 124 to extend and/or retract the respective cables 126, 128, 130, 132. The controller 134 may include a memory 136 and a processor 138. The memory 136 may be a mass storage device, a flash memory device, removable memory, or any other non-transitory computer-readable medium that includes instructions regarding control of the entertainment FIG. 102. The memory 136 may also include volatile memory such as randomly accessible memory (RAM) and/or non-volatile memory such as hard disc memory, flash memory, and/or other suitable memory formats. The processor 138 may execute the instructions stored in the memory 136, such as instructions to adjust the first bogie 112, the second bogie 114, the first winch 122, and/or the second winch 124. In an additional or alternative embodiment, the controller 134 may be implemented to control other features of the entertainment figure system 104. For example, the controller 134 may control certain show effects, including audio (e.g., music) and visual (e.g., video, pyrotechnics) effects, which may further enhance the guests' experience. In a further embodiment, the controller 134 may be implemented to control the guest area 106, which may include adjusting and/or moving the guest area 106 or seating within the guest area 106. Although FIG. 1 illustrates the show system 100 as including one controller 134, there may be any number of controllers 134 implemented in the show system 100.

It should be appreciated that in one embodiment, the guest area 106 may not be separate from the entertainment figure system 104, as depicted in FIG. 1. In other words, guests may be a part of the entertainment figure system 104 (e.g., guests may be seated within the entertainment FIG. 102). Thus, adjustment and/or movement of the entertainment FIG. 102 may also adjust and/or move guests as well. For example, a certain part of the entertainment FIG. 102 may be moved in a vertical direction to move guests in the vertical direction, which may impart forces on the guests to enhance their experience.

Figure 2:
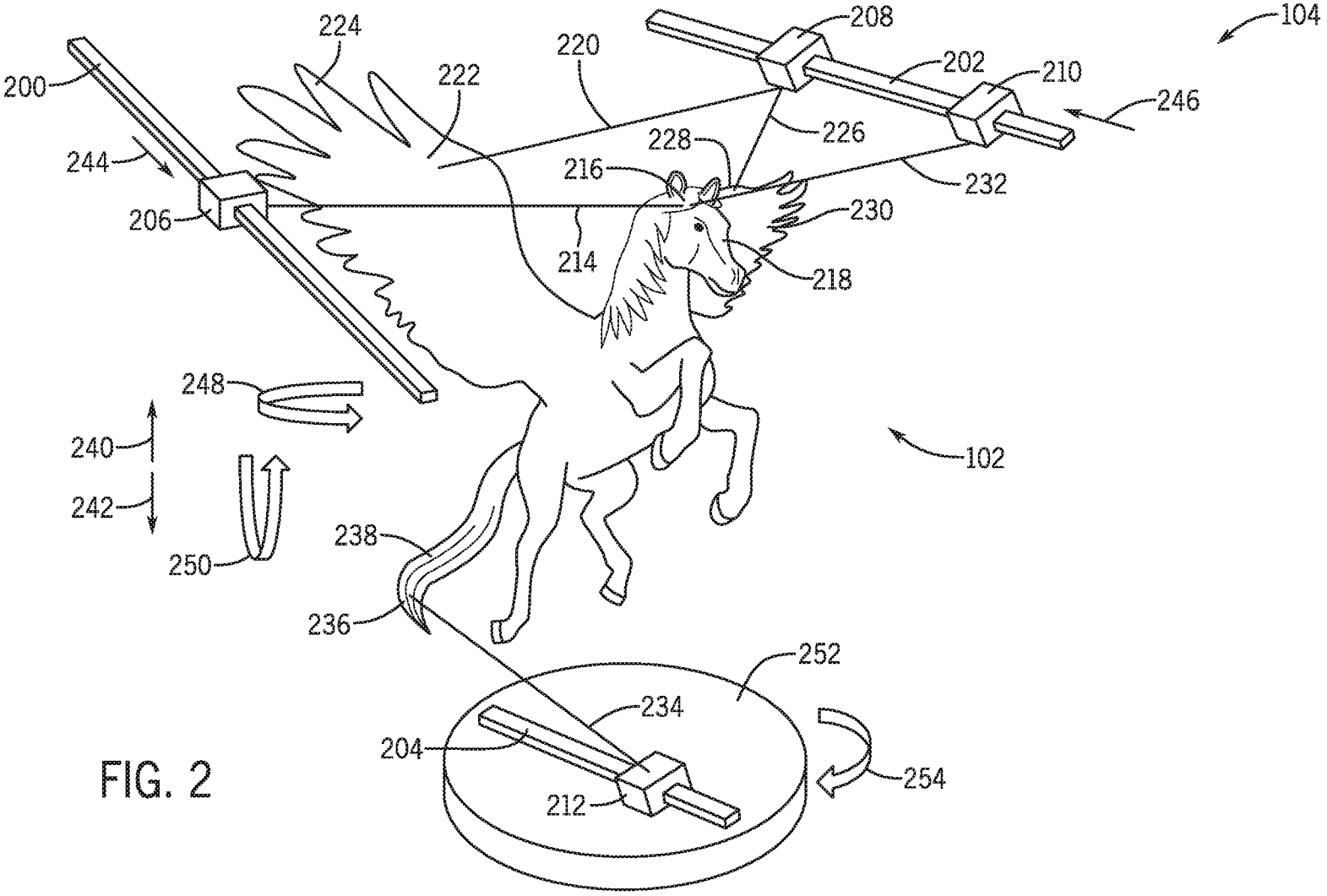
FIG. 2 is a partial perspective view of an embodiment of the entertainment figure system of FIG. 1 depicting an example of the manner in which an entertainment figure may be moved, in accordance with aspects of the present disclosure.

FIG. 2 is a perspective view of an embodiment of the entertainment figure system 104 that includes the entertainment FIG. 102. As an example, the illustrated embodiment of the entertainment FIG. 102 is a winged horse. The illustrated entertainment figure system 104 includes a first track 200, a second track 202, and a third track 204. The first track 200 may include a first bogie 206 implemented to translate along the first track 200. The second track 202 supports a second bogie 208 and a third bogie 210, and the second and/or third bogie 208, 210 may each be configured to translate along the second track 202. The third track 204 supports a fourth bogie 212 configured to translate along the third track 204. Although the tracks 200, 202, 204 and the bogies 206, 208, 210, 212 are each illustrated as having a generally rectangular shape, it should be appreciated that the tracks 200, 202, 204 and the bogies 206, 208, 210, 212 may be of any other suitable shape, such as a cylindrical shape. Further, the bogies 206, 208, 210, 212 may couple to the tracks 200, 202, 204 in any suitable manner.

As depicted in FIG. 2, a first cable 214 may extend from the first bogie 206 to a first attachment point 216 of the entertainment FIG. 102, which may correspond to a head 218 of the entertainment FIG. 102. A second cable 220 may extend from the second bogie 208 to a second attachment point 222 (e.g., on a first wing 224) and a third cable 226 may extend from the second bogie 208 to a third attachment point 228 (e.g., on a second wing 230) of the entertainment FIG. 102. A fourth cable 232 may extend from the third bogie 210 to the first attachment point 216. A fifth cable 234 may extend from the fourth bogie 212 to a fourth attachment point 236 of the entertainment FIG. 102, which may be a tail 238, for example. Each of the bogies 206, 208, 210, 212 may include a respective winch (not shown) to adjust an extended length of the respective cables 214, 220, 226, 232, 234.

It should be understood that other embodiments of the entertainment figure system 104 may include a different number and/or location of the tracks 200, 202, 204, of the bogies 206, 208, 210, 212 implemented to translate on each of the tracks 200, 202, 204, of the attachment points 216, 222, 228, 236 associated with the entertainment FIG. 102, and/or of cables 214, 220, 226, 232, 234 extending from each of the bogies 206, 208, 210, 212 to the respective attachment points 216, 222, 228, 236. For example, at least one of the cables 214, 220, 226, 232, 234 may be attached to multiple attachment points 216, 222, 228, 236 to enhance control of the entertainment FIG. 102.

In the illustrated embodiment of FIG. 2, positioning of the first attachment point 216 may be controlled via extending and/or retracting the first cable 214 and/or the fourth cable 232, for example to move the head 218 from side to side, or to turn the head 218. Positioning of the second attachment point 222 may be controlled via extending and/or retracting the second cable 220, for example to lower and raise the first wing 224. Positioning of the third attachment point 228 may be controlled via extending and/or retracting the third cable 226, for example to lower and raise the second wing 230. Positioning of the fourth attachment point 236 may be controlled via extending and/or retracting the fifth cable 234, for example to move the tail 238.

Each of the bogies 206, 208, 210, 212 may also be controlled to transport the entertainment FIG. 102. Specifically, the bogies 206, 208, 210, 212 may each be configured to translate on the respective tracks 200, 202, 204 to adjust the location of at least a portion of the entertainment FIG. 102. The bogies 206, 208, 210, 212 may each be controlled to translate at a particular velocity and/or direction independent of one another. Thus, even though both the second bogie 208 and the third bogie 210 may each be implemented to translate along the second track 202, the second bogie 208 may translate in a different direction and/or a different velocity than the third bogie 210.

It should be understood that any combination of adjustment of the bogies 206, 208, 210, 212 and/or the cables 214, 220, 226, 232, 234 may be performed to transport and/or move the entertainment FIG. 102. As an example, retracting the first, second, third, and fourth cables 214, 220, 226, 232 while extending the fifth cable 234 may generally move the entertainment FIG. 102 in a first direction 240 (e.g., a vertical direction upwards). Further, extending the first, second, third, and fourth cables 214, 220, 226, 232 while retracting the fifth cable 234 may generally move the entertainment FIG. 102 in a second direction 242 opposite the first direction 240 (e.g., a vertical direction downwards. Thus, the cables 214, 220, 226, 232, 234 may be extended and/or retracted to respectively raise and lower the entertainment FIG. 102. In one embodiment, the cables 214, 220, 226, 232, 234 may be extended and/or retracted at setpoint rates to respectively raise and lower the entertainment FIG. 102 at a desirable velocity, such as to lower the entertainment FIG. 102 at faster speed than that of gravitation forces.

In an additional or alternative embodiment, the bogies 206, 208, 210, 212 and/or the cables 214, 220, 226, 232, 234 may be adjusted to rotate the entertainment FIG. 102. By way of example, the first bogie 206 may translate in a third direction 244 along the first track 200 while the second bogie 208 and the third bogie 210 may translate in a fourth direction 246 along the second track 202 to rotate the entertainment FIG. 102 in a first rotational direction 248. In an additional example, the first cable 214, the fourth cable 232, and the fifth cable 234 may retract while the second cable 220 and the third cable 226 extend to rotate the entertainment FIG. 102 in a second rotational direction 250. It should also be understood that any combination of translation of the bogies 206, 208, 210, 212 and extension and/or retraction of the cables 214, 220, 226, 232, 234 may be performed to rotate the entertainment FIG. 102.

It should be appreciated that the combination of tracks 200, 202, 204, bogies 206, 208, 210, 212, and cables 214, 220, 226, 232, 234 may enable greater control of the entertainment FIG. 102 than certain existing systems, such as robotic arm systems. For example, a target position and/or velocity of each bogie 206, 208, 210, 212 along the respective tracks 200, 202, 204 and a target position and/or velocity of each cable 214, 220, 226, 232, 234 may control a position and/or velocity of the respective attachment points 216, 222, 228, 236 to arrange the entertainment FIG. 102 as desired. Furthermore, the combination of tracks 200, 202, 204, bogies 206, 208, 210, 212, and cables 214, 220, 226, 232, 234 may enable accurate repeatability in arranging the entertainment FIG. 102. That is, the tracks 200, 202, 204 may guide the bogies 206, 208, 210, 212 to translate along a specific path, in which the position of each bogie 206, 208, 210, 212 may be determined and set at a specific location of the respective tracks 200, 202, 204.

Moreover, in certain embodiments, the bogies 206, 208, 210, 212 may rotate about the respective tracks 200, 202, 204 to enhance adjustment of the entertainment FIG. 102. Rotation of the bogies 206, 208, 210, 212 may further permit adjustment of the attachment points 216, 222, 228, 236 by adjusting the angle at which each cable 214, 220, 226, 232, 234 acts on the attachment points 216, 222, 228, 236. For example, rotation of the bogies 206, 208, 210, 212 may adjust the cables 214, 220, 226, 232, 234 to move the attachment points 216, 222, 228, 236 in a manner that would otherwise not be achievable by merely extending and/or adjusting the cables 214, 220, 226, 232, 234.

In a further embodiment, a position of at least one of the tracks 200, 202, 204 may be adjusted. In other words, the tracks 200, 202, 204 may move relative to one another to permit the associated bogies 206, 208, 210, 212 to translate in different directions. For example, the first track 200 may rotate in the second rotational direction 250. In this manner, the first bogie 206 may translate in an incline along the first track 200 in the third direction 244. Movement of the tracks 200, 202, 204 may enable a greater amount of control to adjust the entertainment FIG. 102 by enabling the bogies 206, 208, 210, 212 to translate in additional directions.

As will be appreciated, the entertainment FIG. 102 may include joints to allow articulation of different parts of the entertainment FIG. 102. To this end, the joints allow the attachment points 216, 222, 228, 236 to move independently of one another. In other words, the joints allow different parts of the entertainment FIG. 102 to move separately from and relative to one another, which may produce more lifelike movement of the entertainment FIG. 102.

Adjustment of the bogies 206, 208, 210, 212, of the cables 214, 220, 226, 232, 234, and/or of the tracks 200, 202, 204 may be controlled via a controller (e.g., the controller 134). In some embodiments, multiple controllers may be used, such as a first controller to adjust the bogies 206, 208, 210, 212, a second controller to adjust the cables 214, 220, 226, 232, 234, and a third controller to adjust the tracks 200, 202, 204.

In the embodiment illustrated in FIG. 2, the first track 200 and the second track 202 are positioned above the third track 204, though it should be understood that the first track 200 and the second track 202 may be positioned in any manner relative to one another. As an example, the first track 200 and/or the second track 202 may be coupled to a structure of the entertainment figure system 104 above the entertainment FIG. 102. For example, the first track 200 and/or the second track 202 may be coupled to static support features, such as columns, frames, permanent cables, another suitable feature, or any combination thereof. In this manner, a weight of the entertainment FIG. 102 may be supported by the structure and the tracks 200, 202 in addition to the cables 214, 220, 226, 232 and the bogies 206, 208, 210. In one non-limiting embodiment, the entertainment figure system 104 may support a weight of the entertainment FIG. 102 of up to 1000 kilograms (kg). Furthermore, the third track 204 may be coupled to an additional structure (e.g., static support) of the entertainment figure system 104 below the entertainment FIG. 102. The additional structure may provide additional support of the entertainment FIG. 102, such as by providing an anchor that enables the fifth cable 234 to pull the entertainment FIG. 102 down at a rate faster than a rate at which a gravitational force would pull the entertainment FIG. 102. In an additional or alternative embodiment, the tracks 200, 202, 204 may be coupled to a dynamic feature. For instance, the third track 204 may be coupled to a base 252 configured to rotate in a third rotational direction 254. In this manner, as the base 252 rotates, the third track 204 may also rotate, thereby moving the fourth bogie 212 and/or adjusting an extended length of the fifth cable 234. Further embodiments of dynamic features may translate in a particular direction to move the third track 204.

Figure 3:
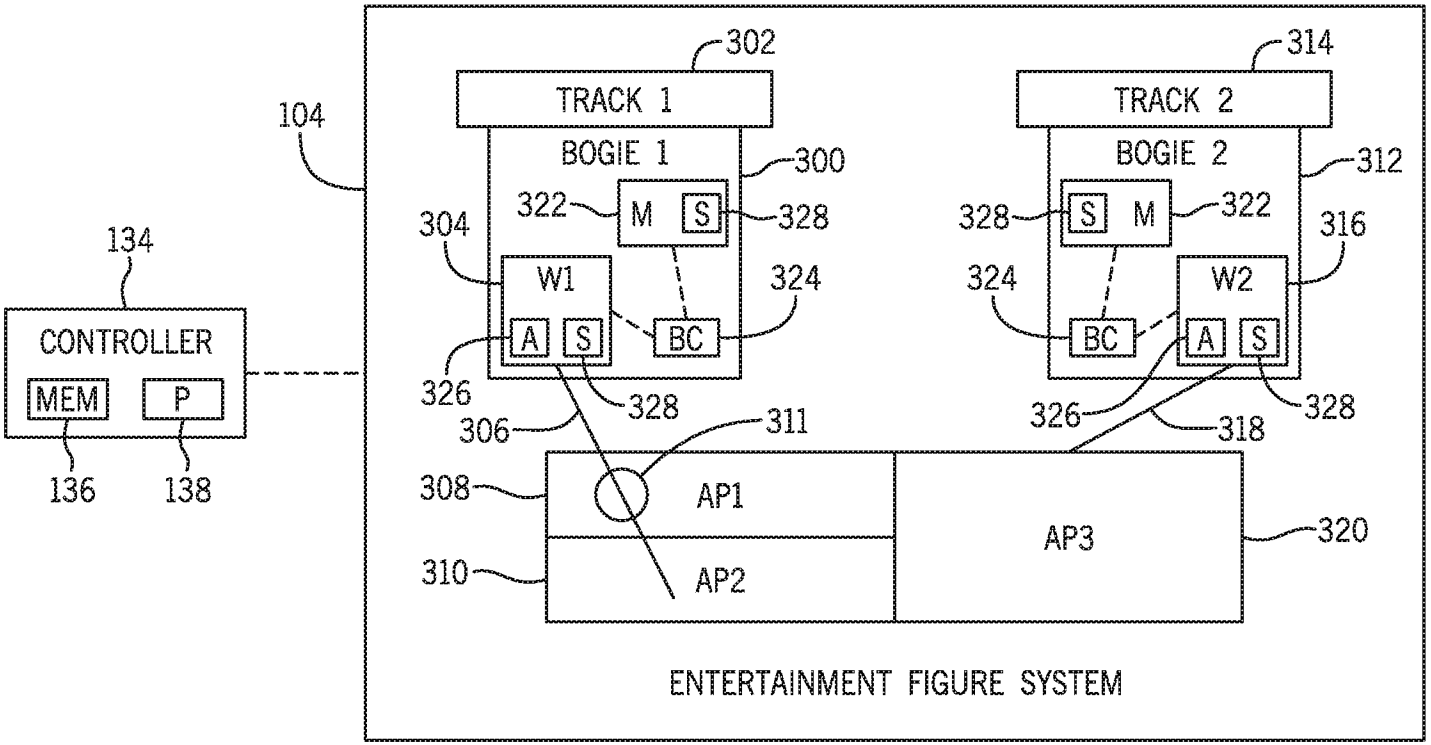
FIG. 3 is a schematic view of various components of the entertainment figure system of FIG. 1, in accordance with aspects of the present disclosure.

FIG. 3 is a schematic view of an embodiment of the entertainment figure system 104 illustrating a mechanism of how attachment points of the entertainment FIG. 102 may be adjusted. The illustrated embodiment of the entertainment figure system 104 includes a first bogie 300 implemented to translate along a first track 302. The first bogie 300 includes a first winch 304, in which a first cable 306 may be coupled to the first winch 304, a first attachment point 308, and a second attachment point 310 of the entertainment FIG. 102. For example, the first attachment point 308 may include a support 311 (e.g., a loop) through which the first cable 306 may be inserted to attach to the second attachment point 310. In this manner, when the first cable 306 is extended and/or retracted via the first winch 304, the first cable 306 may drive both the first attachment point 308 and the second attachment point 310 to move. The entertainment figure system 104 may also include a second bogie 312 implemented to translate along a second track 314. The second bogie 312 includes a second winch 316, in which a second cable 318 may be coupled to the second winch 316 and a third attachment point 320. The first and second bogies 300, 312 may each include a motor 322 implemented to facilitate the first and second bogies 300, 312 to translate along the respective first and second tracks 302, 314.

Additionally, the first and second bogies 300, 312 may each be communicatively coupled to a bogie controller 324, which may be the same or a different controller than the controller 134 of FIG. 1. In some embodiments, the bogie controller 324 may be a programmable logic controller (PLC) configured to control the first winch 304, the second winch 316, and/or the motor 322 of the first bogie 300 and the second bogie 312. As an example, the first winch 304 and/or the second winch 316 may each include an actuator 326. The bogie controller 324 may be configured to activate the actuator 326 to extend and/or retract the cables 306, 318. The bogie controller 324 may also operate the motor 322 to adjust a position of the respective bogies 300, 312 along the respective tracks 302, 314.

In some embodiments, the winches 304, 316 and/or the motor 322 may each include a sensor 328 implemented to detect a particular parameter. For example, the sensors 328 may detect a position of the respective bogies 300, 312 along the respective tracks 302, 314 and/or detect a velocity of the respective bogies 300, 312 translating along the respective tracks 302, 314. The bogie controller 324 may use the detected position and/or velocity to operate the motors 322. The sensors 328 may additionally or alternatively determine an extended length of the respective cables 306, 318 extended by the respective winches 304, 316, a rate at which the respective winches 304, 316 may be extending or retracting the respective cables 306, 318, a tension imparted on the respective cables 306, 318, and/or a torque imparted on the respective winches 304, 316. The bogie controller 324 may use the detected length, rate, tension, and/or torque to operate the actuators 326.

In general, a position of the attachment points 308, 310, 320 may be associated with the respective locations of the bogies 300, 312 and/or the extended length of the cables 306, 318. The position of each attachment point 308, 310, 320 may also be associated with one another. In other words, in certain configurations, adjusting the position of the first attachment point 308 may also adjust the position of the second attachment point 310. For example, since the first cable 306 is coupled to both the first attachment point 308 and the second attachment point 310, adjusting a position and/or extended length of the first cable 306 may adjust the respective positions of both the first attachment point 308 and the second attachment point 310. Subsequently, the position of the third attachment point 320 may also be adjusted from the adjustment of the first attachment point 308 and the second attachment point 310, even if the second cable 318 and/or second bogie 312 associated with the third attachment point 320 was not controlled to be adjusted.

Although FIG. 3 illustrates that the first and second winches 304, 316 are disposed on the respective first and second bogies 300, 312, it should be appreciated that the first and second winches 304, 316 may additionally or alternatively be disposed on the entertainment FIG. 102 (e.g., the attachment points 308, 310, 320). In this manner, the respective cables 306, 318 may be extended and/or retracted from the entertainment FIG. 102. Additionally, although FIG. 3 depicts each bogie 300, 312 as including a separate bogie controller 324, the bogies 300, 312 may be communicatively coupled to the same bogie controller 324. That is, the same bogie controller 324 may adjust the bogies 300, 312 and/or the cables 306, 318.

Figure 4:
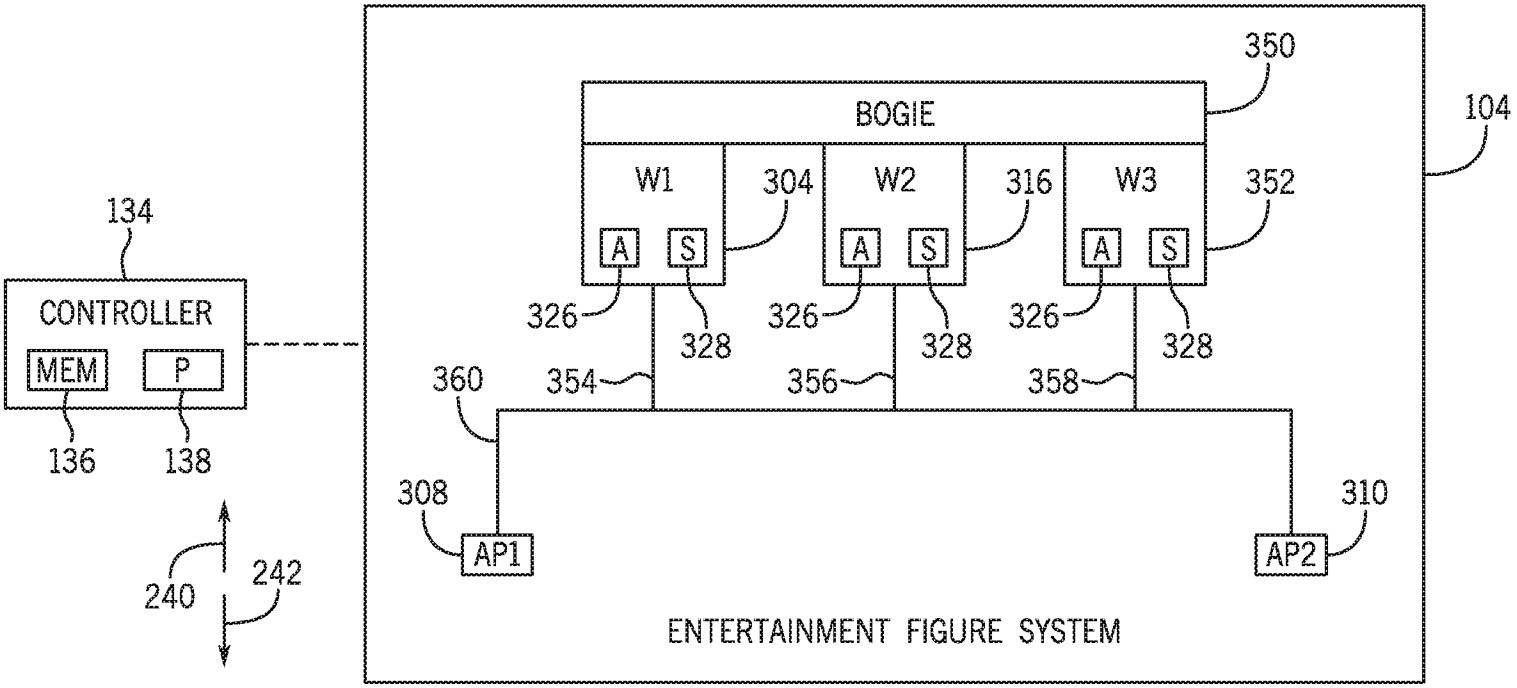
FIG. 4 is a schematic view of an embodiment of the entertainment figure system of FIG. 1 illustrating a configuration in which attachments of the entertainment figure may be controlled, in accordance with aspects of the present disclosure.

FIG. 4 is a schematic view of an embodiment of the entertainment figure system 104 illustrating another configuration in which the first attachment point 308 and the second attachment point 310 may be controlled by a single bogie 350. In the illustrated embodiment, the bogie 350 may include the first winch 304, the second winch 316, and a third winch 352, in which each of the winches 304, 316, 352 includes the actuator 326 and the sensor 328 that are each communicatively coupled to the controller 134. Furthermore, each winch 304, 316, 352 respectively includes a first cable 354, a second cable 356, and a third cable 358. The cables 354, 356, 358 are each respectively attached to a main cable 360, in which the main cable 360 is coupled to the first attachment point 308 and the second attachment point 310.

The controller 134 may control the actuators 326 of each winch 304, 316, 352 to respectively extend and/or retract the cables 354, 356, 358, thereby adjusting the main cable 360. As a result, the positions of the attachment points 308, 310 may also be adjusted. For example, the controller 134 may instruct the third winch 352 to raise the third cable 358 in the first direction 240 by a greater extent than an amount at which the first winch 304 raises the first cable 354 in the first direction 240, thereby moving the second attachment point 310 in the first direction 240 relative to the second attachment point 308. In a further example, the controller 134 may instruct the three winches 304, 316, 352 to raise each of the cables 354, 356, 358 in the first direction 240 by the same amount, thereby raising the entire main cable 360 and raising the attachments points 308, 310 concurrently. In general, the illustrated embodiment may enable the controller 134 to control the position of the attachment points 308, 310 precisely relative to one another.

Figure 5:
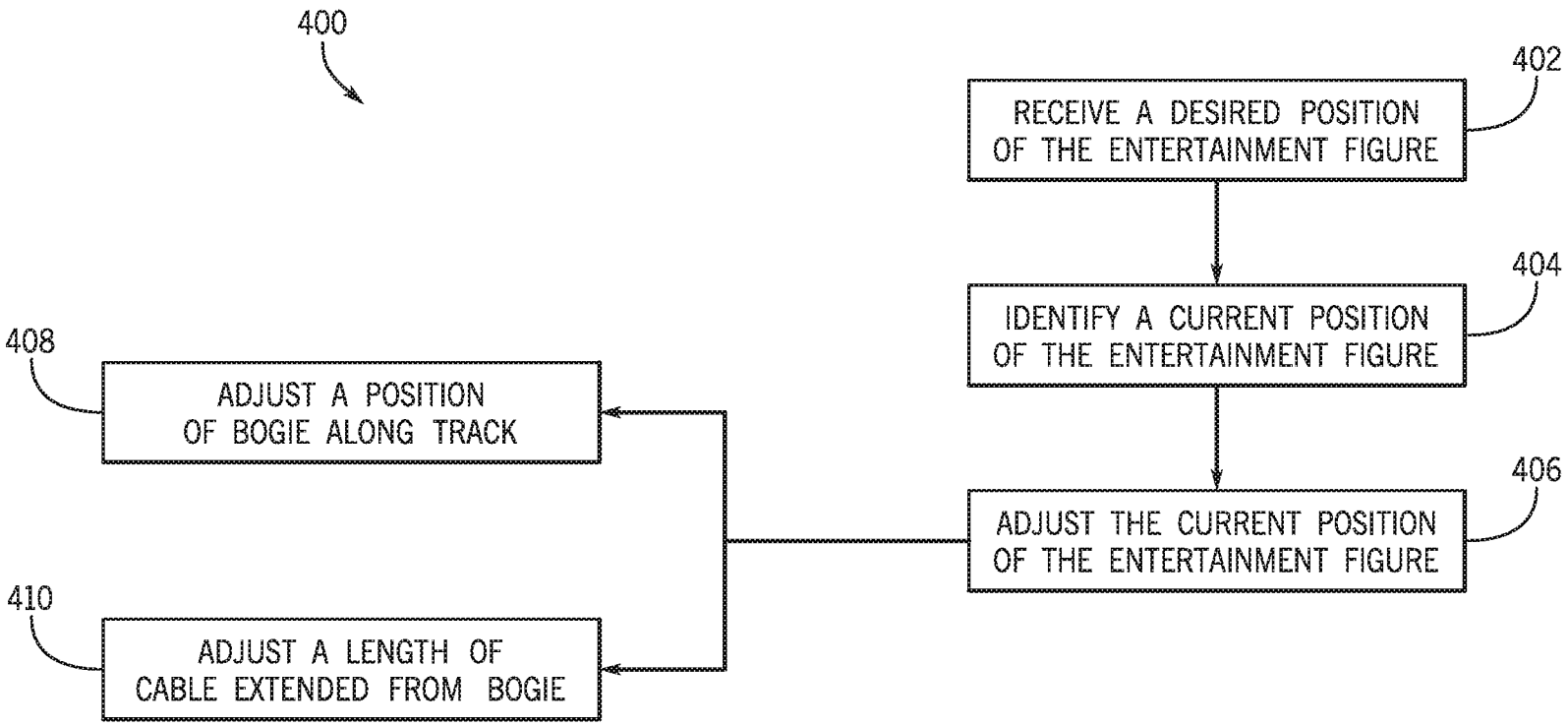
FIG. 5 is a process flow diagram of a method of controlling movement of an entertainment figure, in accordance with aspects of the present disclosure.

FIG. 5 is a block diagram of an embodiment of a method 400 to adjust the entertainment FIG. 102. The method 400 may be performed by, for example, the controller 134 and/or the bogie controller 324. At block 402, a target position of the entertainment FIG. 102 is received. In one embodiment, the target position of the entertainment FIG. 102 includes a target position of each attachment point of the entertainment FIG. 102, such as relative to one another and/or relative to the entertainment figure system 104. However, in an additional or alternative embodiment, the target position of the entertainment FIG. 102 may include a target position of a bogie and/or a cable associated with the entertainment FIG. 102.

At block 404, a current position of the entertainment FIG. 102 is identified. Specifically, the current position of each attachment point of the entertainment FIG. 102 may be identified (e.g., relative to one another and/or relative to the entertainment figure system 104). Additionally or alternatively, the current position of the bogies and/or the cables associated with the entertainment FIG. 102 may be identified. In accordance to such approaches, the identified current position of the entertainment FIG. 102 may be compared to the received target position of the entertainment FIG. 102.

In response to comparing the received target position and the identified current position of the entertainment FIG. 102, the position of the entertainment FIG. 102 may be adjusted, as shown at block 406. In particular, the current position of the entertainment FIG. 102 may be adjusted to match or substantially match the target position of the entertainment FIG. 102.

To accomplish the act associated with block 406, the respective positions of one or more bogies may be adjusted along the respective tracks associated with the entertainment FIG. 102, as indicated at block 408. As previously discussed, each of the bogies may be adjusted independently from one another to adjust the entertainment FIG. 102. Additionally or alternatively, the respective extended lengths of one or more cables may be adjusted, as indicated at block 410. Each cable may be adjusted independently of one another and thus, different cables may be extended and/or retracted. As previously mentioned, other adjustments may also be performed, such as rotation of the bogies and/or adjustment of the tracks on which the bogies are positioned.

It should be understood that blocks 408 and 410 may be performed simultaneously. That is, while the bogies are adjusted along the respective tracks, the respective cables may also be adjusted. However, in an additional or an alternative embodiment, adjustment of the bogies and/or the cables may not be performed simultaneously. For example, certain bogies may be adjusted prior to adjusting certain cables.

In one embodiment, the steps of blocks 408 and 410 may be performed based on a pre-programmed motion profile. For example, the bogie controllers 324 may be programmed with a specific motion profile that may generally set a position, speed, and/or acceleration at which the bogie and/or the cable is adjusted. Based on the selected motion profile, the controller 134 (e.g., via a ride show supervisor or a pre-programmed show control system) may command the bogie controllers 324 to perform one or more of the programmed motion profiles.

In an additional or an alternative embodiment, a speed at which the current position of the entertainment FIG. 102 is adjusted may be based at least in part on the comparison between the received target position and the identified current position of the entertainment FIG. 102. As an example, the speed at which the entertainment FIG. 102 is adjusted may be proportional to a determined difference between the received target position and the identified current position. In other words, if it is determined that the difference between the received target position and the identified current position is substantially small, the entertainment FIG. 102 may be adjusted at a substantially low speed. However, if it is determined that the difference between the received target position and the identified current position is larger, the entertainment FIG. 102 may be adjusted at a higher speed. In an additional or alternative embodiment, a target speed of adjusting the entertainment FIG. 102 may also be received. In other words, in addition to receiving the target position of the entertainment FIG. 102, a target speed at which the entertainment FIG. 102 is to be adjusted (e.g., a target speed or rate to adjust the associated bogies and/or the associated cables) may also be received. Accordingly, the entertainment FIG. 102 may be adjusted at the received target speed.

It should be understood that a particular position of the entertainment FIG. 102 may be achieved in more than one configuration of the bogies and/or cables. That is, positioning the bogie at a first position along the track and extending the cable to a first length may adjust the associated attachment point to a target position. Additionally, positioning the bogie at a second position along the track and extending the cable to a second length may also adjust the associated attachment point to the same target position. However, the adjustment of the bogies and/or the cables may be based on a target movement (e.g., an amount of vertical and/or horizontal movement) of the entertainment FIG. 102. To this end, additionally or alternatively, the entertainment FIG. 102 may be adjusted based on receiving a target movement of the entertainment FIG. 102. For example, the bogies and/or cables may be adjusted accordingly to move an attachment point to a target position via a target movement. Thus, the method 400 may permit the entertainment FIG. 102 to adjust to a target position, at a target velocity, and/or via a target movement.

The method 400 may be performed by a controller, such as the controller 134 and/or the bogie controller 324. In one embodiment, the method 400 may be pre-programmed. In other words, adjustment of the entertainment FIG. 102 may be set at certain times when in operation (e.g., at a particular time of a show). In this manner, the attachment points of the entertainment FIG. 102 may be adjusted to different positions based on the time as determined by the pre-programming. However, additionally or alternatively, adjustment of the entertainment FIG. 102 may be set based on an input. In other words, the controller may receive an input, such as by a user, indicating the target adjustment of the entertainment FIG. 102, such as the target location, speed, and/or movement. Accordingly, the entertainment FIG. 102 adjusts based on the received input.

It should be understood that steps not described in the method 400 may be performed. That is, steps may be performed before the block 402 and/or after the blocks 408 and/or 410. Intermediate steps may also be performed between any of the blocks 402, 404, 406, 408, 410. It should also be appreciated that the steps of the method 400 may be performed in a different order than described.

While only certain features of the disclosure have been illustrated and described herein, many modifications and changes will occur to those skilled in the art. It is, therefore, to be understood that the appended claims are intended to cover all such modifications and changes as fall within the true spirit of the disclosure.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f).

However, for any claims containing elements designated in any other manner, it is intended that such elements are not to be interpreted under 35 U.S.C. 112(f).

The invention claimed is:

1. An entertainment figure system, comprising:

an entertainment figure comprising an attachment point;

a bogie coupled to a track and to the attachment point of the entertainment figure via a cable, wherein the bogie is configured to translate along the track; and a winch coupled to the cable and configured to adjust a length of the cable extending from the winch and thereby modify a distance between the attachment point and the bogie such that the attachment point moves relative to at least one portion of the entertainment figure to change an arrangement of the entertainment figure.

2. The entertainment figure system of claim 1, comprising a show area and a guest area, wherein the entertainment figure is disposed in the show area, and wherein the entertainment figure is configured to be positioned in the guest area via translation of the bogie, adjustment of the length of the cable, or both.

3. The entertainment figure system of claim 1, wherein the bogie is configured to translate along the track and the winch is configured to maintain the length of the cable while the bogie translates along the track to transport at least the at least one portion or another portion of the entertainment figure.

4. The entertainment figure system of claim 1, comprising a controller configured to cause the bogie to translate along the track, to operate the winch to adjust the length of the cable extending from the winch, or both.

5. The entertainment figure system of claim 4, wherein the controller is configured to control operation of the winch to adjust the length of the cable extending from the winch, and wherein the controller is configured to maintain a location of the bogie along the track while operating the winch to adjust the length of the cable extending from the winch to move the attachment point relative to the at least one portion of the entertainment figure.

6. The entertainment figure system of claim 1, wherein the attachment point is a first attachment point, wherein the length is a first length, wherein the distance is a first distance, wherein the amusement park attraction system comprises a second attachment point, and wherein the winch is configured to adjust a second length of the cable extending from the winch and thereby modify a second distance between the second attachment point and the first attachment point concurrently to adjusting the first length of the cable extending from the winch.

7. The entertainment figure system of claim 1, wherein the attachment point is a first attachment point, wherein the cable is a first cable, wherein the length is a first length, wherein the distance is a first distance, wherein the entertainment figure comprises a second attachment point, wherein the bogie is coupled to the track and to the second attachment point of the entertainment figure via a second cable, and wherein the amusement park attraction system comprises a second winch coupled to the second cable and configured to adjust a second length of the second cable extending from the second winch and thereby modify a second distance between the second attachment point and the bogie.

8. The entertainment figure system of claim 1, wherein the bogie is rotatably coupled to the track.

9. The entertainment figure system of claim 1, wherein the winch is disposed on the bogie.

10. The entertainment figure system of claim 1, wherein the entertainment figure comprises an additional portion and the attachment point is located at the additional portion, wherein the entertainment figure comprises a joint between the additional portion and the at least one portion, and wherein the joint is configured to enable movement of the additional portion relative to the at least one portion of the entertainment figure to move the attachment point relative to the at least one portion of the entertainment figure.

11. An entertainment figure system, comprising:

an entertainment figure comprising an attachment point;

a bogie coupled to a track and to the attachment point of the entertainment figure via a cable, wherein the bogie comprises a motor;

a winch coupled to the cable and configured to adjust a length of the cable extending from the winch and thereby modify a distance between the attachment point and the bogie, wherein the winch comprises an actuator; and a controller communicatively coupled to the bogie and to the winch, wherein the controller is configured to activate the motor of the bogie to translate and thereby adjust a location of the bogie along the track, and wherein the controller is configured to activate the actuator of the winch to adjust the length of the cable extending from the winch.

12. The entertainment figure system of claim 11, wherein the controller is configured to receive an input from a sensor, from a user, or both, wherein the controller is configured to adjust the location of the bogie, the length of the cable extending from the winch, or both, based at least in part on the received input.

13. The entertainment figure system of claim 12, wherein the received input comprises a target location of the bogie, a target length of the cable extending from the winch, a target position of the attachment point, a target speed of the bogie translating along the track, a target rate of the cable adjusted by the winch, a target movement of the attachment point, a time, or any combination thereof.

14. The entertainment figure system of claim 11, wherein the track is coupled to a base, and wherein the controller is configured to adjust a position of the base to move the track.

15. The entertainment figure system of claim 11, comprising a sensor disposed on the winch, wherein the sensor is configured to detect an operating parameter, wherein the operating parameter comprises the location of the bogie, the length of the cable extending from the winch, a position of the attachment point, a speed of the bogie translating along the track, a rate of the cable adjusted by the winch, a tension imparted on the cable, a torque imparted on the winch, or any combination thereof, and wherein the controller is configured to activate the motor of the bogie to adjust the location of the bogie, activate the actuator of the winch to adjust the length of the cable extending from the winch, or both, based on the operating parameter.

16. An entertainment figure system, comprising:

an entertainment figure comprising a first attachment point and a second attachment point;

a first bogie coupled to a first track and to the first attachment point via a first cable, wherein the first track is positioned between the entertainment figure and a ceiling, wherein the first bogie is configured to translate along the first track;

a second bogie coupled to a second track and to the second attachment point via a second cable, wherein the second track is positioned between the entertainment figure and a floor, wherein the second bogie is configured to translate along the second track;

a first winch coupled to the first cable and configured to adjust a first length of the first cable extending from the first winch and thereby modify a first distance between the first attachment point and the first bogie; and a second winch coupled to the second cable and configured to adjust a second length of the second cable extending from the second winch and thereby modify a second distance between the second attachment point and the second bogie such that a third distance between the first attachment point and the second attachment point changes to arrange the first attachment point relative to the second attachment point.

17. The entertainment figure system of claim 16, comprising:

a third bogie coupled to the second track and to a third attachment point via a third cable, wherein the third bogie is configured to translate along the second track independently of the second bogie; and a third winch coupled to the third cable and configured to adjust a third length of the third cable extending from the third winch and thereby modify a fourth distance between the third attachment point and the third bogie.

18. The entertainment figure system of claim 16, wherein the entertainment figure comprises a third attachment point, wherein the second bogie is coupled to the third attachment point via a third cable and wherein the amusement park attraction system comprises a third winch configured to adjust a third length of the third cable and thereby modify a fourth distance between the third attachment point and the second bogie.

19. The entertainment figure system of claim 16, wherein the first track is coupled to a base, wherein the base is configured to move the first track with respect to the second track.

20. The entertainment figure system of claim 16, comprising a controller, wherein the controller is configured to operate the first winch to retract the first cable and operate the second winch to extend the second cable while the first winch retracts the first cable to raise the entertainment figure, and wherein the controller is configured to operate the first winch to extend the first cable and operate the second winch to retract the second cable while the second winch extends the first cable to lower the entertainment figure.

* * * * *